US005247802A

United States Patent [19]

Maniez et al.

[11] Patent Number: 5,247,802

[45] Date of Patent: Sep. 28, 1993

[54] METHOD FOR RECOVERING REFRIGERANT

[75] Inventors: Michel J. Maniez, Flemington, N.J.; Henry Grandin, Richboro; Thomas J. Moffatt, Doylestown, both of Pa.

[73] Assignee: National Refrigeration Products, Bensalem, Pa.

[21] Appl. No.: 775,633

[22] Filed: Oct. 10, 1991

Related U.S. Application Data

[63] Continuation-in-part of Ser. No. 688,191, Apr. 19, 1991, which is a continuation-in-part of Ser. No. 618,193, Nov. 26, 1990, Pat. No. 5,170,632.

[51] Int. Cl.[5] ..... F25B 45/00

[52] U.S. Cl. ..... 62/77; 62/149; 62/292; 62/475

[58] Field of Search ..... 62/77, 85, 749, 292, 62/475, 50.1

[56] References Cited

U.S. PATENT DOCUMENTS

| | | | |
|---|---|---|---|
| 3,232,070 | 2/1966 | Sparano | 62/149 |
| 3,425,238 | 5/1967 | Sylvan | 62/507 |
| 4,170,116 | 10/1979 | Williams | 62/116 |
| 4,242,878 | 1/1981 | Brinkerhoff | 62/119 |
| 4,285,206 | 8/1981 | Koser | 62/126 |
| 4,363,222 | 12/1982 | Cain | 62/292 |
| 4,458,497 | 7/1984 | Kubik | 62/77 |
| 4,476,688 | 10/1984 | Goddard | 62/149 |
| 4,476,693 | 10/1984 | Johnson | 62/402 |
| 4,480,446 | 11/1984 | Margulefsky et al. | 62/474 |
| 4,513,578 | 4/1985 | Proctor et al. | 62/149 |
| 4,550,573 | 11/1985 | Rannenberg | 62/172 |
| 4,566,291 | 1/1986 | Halavais | 62/402 |
| 4,584,838 | 4/1986 | AbuJudom | 62/5 |
| 4,688,388 | 8/1987 | Lower et al. | 62/126 |
| 4,766,733 | 8/1988 | Scuderi | 62/77 |
| 4,805,416 | 2/1989 | Manz et al. | 62/292 |
| 4,809,515 | 3/1989 | Houwink | 62/149 |
| 4,809,520 | 3/1989 | Manz et al. | 62/292 |
| 4,856,289 | 8/1989 | Lofland | 62/149 |
| 4,856,290 | 8/1989 | Rodda | 62/149 |
| 4,934,390 | 6/1990 | Sapp | 134/22.18 |
| 4,938,031 | 7/1990 | Manz et al. | 62/145 |
| 4,942,741 | 7/1990 | Hancock et al. | 62/292 |
| 4,969,495 | 11/1990 | Grant | 141/98 |
| 4,996,848 | 3/1991 | Nelson et al. | 62/77 |
| 4,998,413 | 3/1991 | Sato | 62/149 |
| 5,020,331 | 6/1991 | Michny | 62/77 |
| 5,046,320 | 9/1991 | Loose et al. | 62/77 |
| 5,095,713 | 3/1992 | Laukhuf et al. | 62/149 |
| 5,127,239 | 7/1992 | Manz et al. | 62/292 |

OTHER PUBLICATIONS

"CFC Refrigerant-Depumping-Station Fast 120 Operator's Manual", Fischer Kalte-Klima (Mar. 30, 1989 Germ.).

"Functions of CFC Depumping Station Fast 120" US-Version, Fischer Kalte-Klima, Feb. 6, 1990 (5 sheets drawings).

(List continued on next page.)

*Primary Examiner*—John N. Sollecito

*Attorney, Agent, or Firm*—Panitch Schwarze Jacobs & Nadel

[57] ABSTRACT

A portable refrigerant recovery unit including a compressor, a condenser and an internal receiver or container for recovering refrigerant from a refrigeration unit or other container. A level measuring device determines the level of liquid refrigerant in the internal container. A control device responds to the level measuring device and disables the compressor when the liquid refrigerant in the internal container reaches a predetermined level. Refrigerant can be temporarily stored within the internal container or passed through the internal container to an external container as refrigerant is being removed from the refrigeration unit. The compressor inlet can be directly coupled with the condenser, the compressor outlet directly coupled with the internal container and the internal container isolated from the condenser outlet to vaporize residual refrigerant and to evacuate the vaporized refrigerant from the condenser and most connective piping of the unit and to use the evacuated refrigerant vapor to expel liquid refrigerant from the internal container.

8 Claims, 1 Drawing Sheet

OTHER PUBLICATIONS

"Refrigerant Recovery and Recycling Station, Model No. 17200," Robinair Division Sealed Power Corp., 1988.

"Fishcer informiert, FCKW-Absaugstationen fur den Praxisgerechten Einsatz!" Feb. 1989.

K. W. Manz, "How to Handle Multiple Refrigerants in Recovery and Recycling Equipment", ASHRAE Journal, Apr. 1991, 22-30.

"ACCA Surveys 13 Producers of Recovery/Recycle Units; Criticizes Weight, Speed," *Air Conditioning, Heating & Refrigeration News,* Aug. 21, 1989, pp. 32-33.

"Refrigerant Recovery Systems," Davco Manufacturing Co., Aug. 25, 1989.

METHOD FOR RECOVERING REFRIGERANT

CROSS REFERENCE TO RELATED APPLICATION

This application is a continuation-in-part of copending U.S. patent application Ser. No. 07/688,191, filed Apr. 19, 1991, which is a continuation-in-part of copending U.S. patent application Ser. No. 07/618,193, filed Nov. 26, 1990.

FIELD OF THE INVENTION

The invention relates to a method and apparatus for recovering refrigerant and, more particularly, to a portable refrigerant recovery unit having an internal container and methods of recovering refrigerant.

BACKGROUND OF THE INVENTION

Many refrigeration units, such as household refrigerators, air conditioning units, heat pumps, vending machines for soft drinks, water coolers for drinking water, and other small air conditioning and refrigeration systems use chlorofluorocarbons (CFC's), hydrochlorofluorocarbons CFC's as refrigerants is discussed in detail in U.S. Pat. No. 5,020,331 which is hereby incorporated by reference in its entirety.

It is desirable to avoid open air release of CFC's, which damage the ozone layer of the atmosphere, during transfer of refrigerant to and from such equipment. The reclamation of such refrigerants is both ecologically and economically desirable.

It would be advantageous to have a hand carryable refrigerant recovery unit of limited size and weight having an internal storage tank or container for use in areas where it is not convenient to carry a large recovery unit and separate refrigerant recovery cylinder. Small appliances such as house refrigerators or air conditioning units typically hold refrigerant charges of up to four pounds. Therefore, the internal container must possess sufficient capacity to accommodate the refrigerant charge from at least one small appliance unit. Preferably, the internal container has sufficient capacity to accommodate refrigerant from several refrigerators or other appliances and means for monitoring the level of refrigerant within the container and controlling the flow of refrigerant into the unit when the refrigerant level within the container exceeds a predetermined value.

In addition, it is desirable to have a refrigerant recovery unit which may be connected to a relatively large external tank to allow for evacuation of substantially all of the refrigerant from the internal container and unit and to alternatively allow the refrigerant to be directly stored within the external tank.

In the prior art, there is disclosed a self-contained refrigerant recovery and purification system. The refrigerant withdrawn from a disabled refrigeration unit is initially passed through an oil trap and acid purification filter-drier to remove impurities before the refrigerant gas enters a compressor. The compressed gas is passed through a conduit containing a cutoff valve, a check valve, a purge valve, and a high pressure switch. The gas is converted to a liquid by passage through the condensing coil of a condenser-evaporator. The liquefied refrigerant is then passed through an acid-purification filter-drier and into a receiving tank. The level of refrigerant within the receiving tank is not monitored and no control means is provided to control refrigerant input to the system based upon the level of refrigerant in the tank. The liquefied gas may be discharged to an external holding tank or a portion of the liquefied gas may be used to cool the gas in the condenser coil. The high pressure purge feature allows residual refrigerant in the system to be purged to the atmosphere.

A portable refrigerant recovery and purification system is disclosed in the prior art which consists of an evaporator, a compressor, a condenser, and a refrigerant storage container mounted on a two-wheeled hand truck. Refrigerant is passed through the evaporator, compressed by the compressor, reliquefied at the condenser and fed to a storage container.

One system and method for withdrawing and charging refrigerant from or into a refrigeration system passes withdrawn refrigerant through a vaporizing coil to prevent liquid refrigerant from entering a positive displacement transfer pump. Refrigerant vapor from the pump outlet is liquefied in a cooling coil/heat exchanger, which is, in turn, in communication with a refrigerant disposable storage container.

Another known refrigerant reclamation and charging unit has a compressor and condenser which uses a portion of the refrigerant being evacuated to continuously cool itself. In the reclamation mode, the refrigerant flows in the direction of a standard refrigerant receiver or container by means of a pressure differential created by the cooling.

A refrigerant recovery apparatus is disclosed in the prior art, in which the recovered refrigerant is passed through a filter-dryer acid neutralizer and vapor-liquid separator. The predominantly liquid component is contact-condensed by the cooled refrigerant in the storage reservoir. The predominantly gaseous component is recycled through the compressor and condenser circuit.

SUMMARY OF THE INVENTION

Briefly, one aspect of the present invention is a portable refrigerant recovery unit for recovering refrigerant from a container. The unit comprises a compressor means having an inlet and outlet. The compressor means is for receiving a refrigerant at the inlet at a first pressure and expelling refrigerant from the outlet at a second pressure higher than the first pressure. The unit comprises an inlet conduit having a first end to receive refrigerant into the unit and a second end in fluid communication with the compressor means inlet. The unit also comprises an internal container having an inlet and an outlet. An intermediate conduit has a first end in fluid communication with the compressor means outlet and a second end in fluid communication with the internal container inlet. An outlet conduit has a first end in fluid communication with the internal container outlet and a second end to discharge refrigerant from the unit. A first junction is located in the inlet conduit between the first and second ends of the inlet conduit. Second, third, and fourth junctions are sequentially located between the first and second ends of the intermediate conduit. First valve means is located in the intermediate conduit between the second and third junctions for controlling refrigerant flow between the second and third junctions. Second valve means is located in the intermediate conduit between the third and fourth junctions for controlling refrigerant flow between the fourth and third junctions. A return conduit extends between the first and third junctions. Third valve means is located in the return conduit for controlling flow of refrigerant through the return conduit. A by-pass conduit extends between the second and fourth junctions. Fourth valve means is located in the by-pass conduit for controlling refrigerant flow through the by-pass conduit. Level measuring means is provided for determining a level of substantially liquid refrigerant in the internal container. The unit also comprises control means in communication with the level measuring means for disabling the compressor means when the level measuring means determines that the level of substantially liquid refrigerant in the internal container has reached a predetermined level.

A further aspect of the present invention is a portable unit for recovering refrigerant vapor from a container. The unit comprises a compressor having inlet means for receiving refrigerant vapor at a first pressure and outlet means for expelling refrigerant vapor at a second pressure above atmospheric pressure and the first pressure. The unit also comprises cooling means for condensing refrigerant vapor. The cooling means has inlet means for receiving refrigerant vapor and outlet means for supplying liquid refrigerant condensed from the vapor. An internal container is provided having inlet means for conveying refrigerant into the internal container for storage and outlet means separate from the inlet means for conveying refrigerant out of the internal container. First means is provided for selectively fluidly coupling the compressor inlet means with one of the container and the cooling means. Second means is provided for selectively fluidly coupling the compressor outlet means with one of the inlet means of the cooling means and the internal container inlet means. Third means is provided for selectively fluidly coupling the internal container inlet means with the outlet means of one of the cooling means and the compressor.

Another aspect of the present invention is a method for recovering refrigerant from a container and storing the refrigerant within an internal container of a portable refrigerant recovery unit. The method comprises the steps of: removing substantially vaporized refrigerant from the container; compressing the removed substantially vaporized refrigerant to form a pressurized refrigerant; condensing the pressurized refrigerant to form a substantially liquid refrigerant; transferring the substantially liquid refrigerant to an internal container located within the unit to thereby fill the internal container; determining a level of the substantially liquid refrigerant within the internal container; and automatically ceasing the removal of the substantially vaporized refrigerant from the container when the level of the substantially liquid refrigerant within the internal container exceeds a predetermined level.

Another aspect of the present invention is a method for recovering refrigerant from a container, temporarily storing the refrigerant within an internal container of a portable refrigerant recovery unit, and transferring the refrigerant to an external container. The method comprises the steps of: removing substantially vaporized refrigerant from the container; compressing the removed substantially vaporized refrigerant to form a pressurized refrigerant; condensing the pressurized refrigerant to form a substantially liquid refrigerant; transferring the substantially liquid refrigerant to an internal container located within the unit to thereby fill the internal container; and transferring the substantially liquid refrigerant from the internal container to an external container when the substantially liquid refrigerant within the internal container exceeds a predetermined level.

Another aspect of the present invention is a method for transferring a substantially liquid refrigerant from an internal container of a portable refrigerant recovery unit to an external container. The unit further includes compressor means and a condenser, the compressor means having an inlet in fluid communication with the condenser and an outlet in fluid communication with the internal container. The method comprises the steps of actuating the compressor means to draw substantially vaporized refrigerant from the condenser and to compress the substantially vaporized refrigerant to form a compressed vaporized refrigerant; and displacing the substantially liquid refrigerant from the internal container to the external container with the compressed vaporized refrigerant.

BRIEF DESCRIPTION OF THE DRAWING

The foregoing summary, as well as the following detailed description of the preferred embodiment, will be better understood when read in conjunction with the appended drawing. For the purpose of illustrating the invention, there is shown in the drawing an embodiment which is presently preferred, it being understood, however, that the invention is not limited to the specific methods and instrumentalities disclosed. In the drawing.

DESCRIPTION OF THE PREFERRED EMBODIMENT

Figure 1:
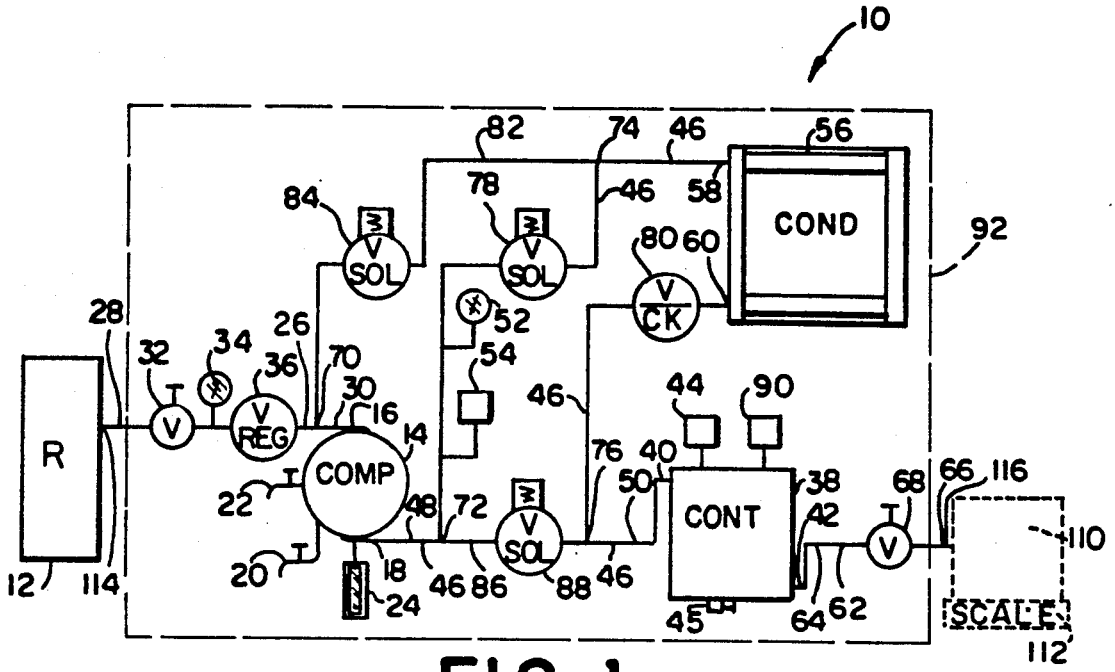
FIG. 1 is a schematic diagram of a portable refrigerant recovery unit and an external container, in accordance with the present invention.
Figure 2:
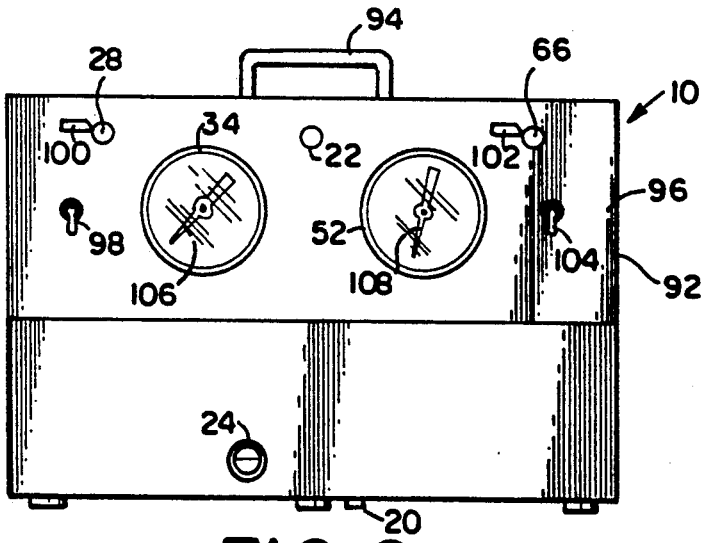
FIG. 2 is a front elevational view of the portable refrigerant recovery unit.

Referring to the drawing, wherein like numerals indicate like elements throughout, there is shown in FIGS. 1 and 2 a preferred embodiment of a portable refrigerant recovery unit, generally designated 10, in accordance with the present invention.

As best shown in FIG. 1, the portable refrigerant recovery unit 10 is used for recovering refrigerant from a container 12. The container 12 may typically be a small appliance, such as a household refrigerator, air conditioning unit, heat pump, a vending machine for soft drinks, water cooler for drinking water, or any other small air conditioning and refrigeration system well known to one of ordinary skill in the art. The present portable recovery unit would typically be used to recover refrigerant from refrigerant containers having approximately one ounce to approximately four pounds of refrigerant charged therein. However, it is understood by those skilled in the art that the present portable refrigerant recovery unit 10 may be used to transfer less than one ounce or greater than four pounds of refrigerant. The present invention is also not limited to use with the specific types of refrigerant containers discussed above, but may also be used to recover refrigerant from automotive air conditioners, for example, as is understood by the ordinarily skilled artisan.

The refrigerant to be transferred is preferably of the high pressure type which exists as both a liquid and a gas at room temperature within the pressurized container 12. Preferably, refrigerants such as R-12, R-22, R-500, R-502, and R-134A may be recovered by use of the present invention. One skilled in the art would understand that a wide variety of refrigerants, too numerous to mention, may also be transferred in accordance with the present invention.

Referring now to FIG. 1, the portable refrigerant recovery unit 10 (encompassed in phantom) includes a compressor means for recovering refrigerant from the container 12. In the present embodiment, it is preferred that the compressor means be comprised of a compressor 14. The compressor 14 has an inlet 16 to receive vaporized refrigerant. The compressor 14 also includes an outlet 18 to expel refrigerant. Preferably, the compressor 14 is configured to produce a first or relatively lower pressure or partial vacuum at the inlet 16 for drawing refrigerant into the compressor 14. The compressor 14 transfers or moves refrigerant through the remainder of the portable refrigerant recovery unit 10 by expelling refrigerant at the compressor outlet 18 at a second pressure above atmospheric pressure and above the pressure of the inlet 16 of the compressor 14.

Preferably, the unit 10 is capable of recovering ⅓ lb/min of vaporized refrigerant from the container 12, although one skilled in the art would understand that the transfer rate may vary based upon such variables as the type of compressor, other equipment selected and the type of refrigerant being transferred and the pressure of the refrigerant. In the present embodiment, the compressor 14 is preferably a standard off-the-shelf item well understood by those skilled in the art. More particularly, the compressor is preferably available from Aspera, located in Calumet City, Ill., as Model No. E6187B. It is understood by those skilled in the art, however that other means could be utilized to recover liquid and/or vapor refrigerant from the container 12, such as a liquid/vapor pump. The specific internal configurations and elements of the compressor 14 and motor are within the knowledge of those of ordinary skill in the compressor art and, therefore, further description thereof is omitted for convenience only and is neither believed to be necessary nor limiting.

If the unit 10 is to be used to recover different types of refrigerants, the unit 10 must be evacuated and the compressor oil (not shown) must be changed prior to transferring a different refrigerant. The normal oil charge for the compressor 14, for example, is approximately 10 ounces. Up to ½ ounce of the refrigerant may be trapped in the compressor oil after transfer. As shown in FIGS. 1 and 2, contaminated compressor oil is drained through the oil outlet port 20 and recharged through the oil inlet port 22. Since a small amount of compressor oil may dissipate during operation, the compressor 14 includes means for monitoring the level of oil in the compressor 14. In the present embodiment, the means is preferably a sight glass 24. However, other means can be used to monitor the level of oil in the compressor 14, such as a gauge or dip stick (not shown). In the event that the level of oil is insufficient, oil may be added through the oil inlet port 22 to compensate for any deficiency in the oil level.

As shown in FIG. 1, the portable refrigerant recovery unit 10 includes an inlet conduit 26 having a first end 28 to receive refrigerant into the unit 10. The inlet conduit 26 has a second end 30 in fluid communication, and preferably directly coupled, with the compressor inlet 16 for inputting refrigerant to the compressor 16. Preferably, the inlet conduit 26 and the other conduits described hereinafter are formed from copper tubing, unless otherwise indicated. However, one skilled in the art understands that the inlet conduit 26 may be formed from any material which is impervious to the refrigerant to be transferred, such as flexible hoses.

The inlet conduit 26 preferably includes an inlet valve means or inlet valve 32 proximal the first end 28 thereof for controlling refrigerant flow through the first end 28 and for closing off the refrigerant input side of the unit 10. Preferably, the inlet valve 32 is a hand-operated ball valve. It is understood that any other suitable type of valve could be used as the inlet valve 32. For instance, the inlet valve 32 may be controlled automatically by use of a solenoid.

As shown in FIGS. 1 and 2, a standard pressure indicator or gauge 34 is located between the inlet valve 32 and the second end 30 of the inlet conduit 26 for indicating the pressure fluid or refrigerant within that portion of the inlet conduit 26. As discussed in more detail hereinafter, the pressure gauge 34 is used to determine whether refrigerant is being transferred by the compressor 14. As best shown in FIG. 2, the pressure gauge 34 may be mounted externally on the housing 92 for easy viewing.

Preferably, the unit 10 further comprises pressure regulating means in fluid communication with the inlet conduit 26 for controlling the pressure of the refrigerant at the inlet 16 of the compressor 14. Preferably, the pressure regulating means is a standard adjustable pressure regulating valve 36, such as that commercially available from Sporlan Valve Co. of St. Louis, Mo., as Model No. CRO-4-0/50. The pressure regulating valve 36 may be used with refrigerants having a maximum temperature of 250° F. and a maximum pressure of 300 psig. For example, for the transfer of refrigerant, the pressure regulating valve 36 is set to a maximum of 50 psig. One skilled in the art understands that other pressure regulating means can be used, such as a nonadjustable pressure regulating valve (not shown), without departing from the spirit and scope of the present invention. The use of a pressure regulating valve 36 allows transfer of refrigerants having a higher vapor pressure than R-12, such as R-22, R-134A, R-500, and R-502, without damaging the compressor 14.

The portable refrigerant recovery unit 10 further comprises an internal container 38. The internal container 38 is preferably a relatively small storage tank and is preferably sufficiently sized to store at least about 4 lbs. of refrigerant, under pressure, although one of ordinary skill in the art would understand that the internal container 38 may be of any configuration or size in keeping with the spirit and scope of the present invention.

Preferably, the internal container 38 is formed from steel, however, one skilled in the art understands that the internal container 38 may be formed from any material, such as aluminum which is impervious to and possesses sufficient strength to contain the refrigerant to be recovered.

As best shown in FIG. 1, the internal container 38 has an inlet 40 for receiving refrigerant for storage. The internal container 38 has an outlet 42 for expelling refrigerant from the internal container 38. It is preferred that the inlet 40 be positioned at a higher elevation than the outlet 42. For safety purposes, it is preferred that the internal container 38 include a high-pressure relief valve 44 for venting excess pressure within the internal container 38. Preferably, the high-pressure relief device 44 has a relief pressure setting of 350 psi. A draincock 45 or other similar draining means may also be provided in the bottom of the container 38 for draining or flushing any non-condensible residues which may collect in the bottom of container 38.

The portable refrigerant recovery unit 10 comprises an intermediate conduit 46. The intermediate conduit 46 has a first end 48 in fluid communication with the compressor means outlet 18. The intermediate conduit 46 has a second end 50 in fluid communication with the internal container inlet 40 for inputting refrigerant to the internal container 38.

Preferably, a pressure gauge 52 is in fluid communication with the intermediate conduit 46 proximate the outlet 18 of the compressor 14 for indicating the pressure of fluid or refrigerant within that portion of the intermediate conduit 46. As best shown in FIG. 2, the pressure gauge 52 may be mounted externally on the housing 92 for easy viewing. For safety purposes, it is preferred that the intermediate conduit 46 include a high-pressure cutout switch 54 for deactivating the compressor 14 if flow through the intermediate conduit 46 is blocked or impeded. Preferably, the high-pressure cutout switch 54 has a cutout pressure setting of 350 psi, although other pressures (e.g., 400 psi) may be utilized as desired.

As shown in FIG. 1, the intermediate conduit 46 includes refrigerant cooling means in fluid communication with the compressor outlet 18 for receiving and cooling refrigerant expelled from the compressor 14 and condensing the refrigerant from the vapor phase to the liquid phase. In the present embodiment, it is preferred that the cooling means be comprised of a condenser coil 56 equipped with cooling fins (not shown) and air cooling means (not shown). Preferably, the air cooling means is a bladed fan positioned to impinge air on the condenser coil 56. The fan is preferably powered by an electrically driven fan motor, although it is understood by those skilled in the art that the fan may be driven by a pneumatic or hydraulic motor (not shown) without departing from the spirit and scope of the present invention. The condenser coil 56 includes an inlet 58 and outlet 60, the inlet 58 being at a higher elevation than the outlet 60 for assisting the flow of refrigerant through the condenser coil 56.

The portable refrigerant recovery unit 10 includes an outlet conduit 62. The outlet conduit 62 has a first end 64 in fluid communication with the internal container outlet 42. The outlet conduit 62 also has a second end 66 to discharge refrigerant from the unit 10.

The refrigerant transfer unit 10 preferably includes an outlet valve means or outlet valve 68 in fluid communication with the outlet conduit 62 proximal the second end 66 for controlling the discharge of refrigerant through the second end 66. Preferably, the outlet valve 68 comprises a hand-operated ball valve similar to the inlet valve 32. It is understood by those skilled in the art that the outlet valve 68 may be any other suitable type of valve, such as a ball valve, and may be controlled automatically, such as by use of a solenoid.

As best shown in FIG. 1, the inlet conduit 26 includes a first junction 70 between the first and second ends 28, 30 thereof. In addition, second, third, and fourth junctions 72, 74, 76 are sequentially located between the first and second ends 48, 50 of the intermediate conduit 46. All of the aforementioned junctions 70, 72, 74, 76, are generally "T-shaped", although one of ordinary skill would understand that these junctions may occur at any angle without departing from the spirit and scope of the present invention. The intermediate conduit 46 includes a first valve means in between the second and third junctions 72, 74 for controlling refrigerant flow between the second and third junctions 72, 74. Presently, it is preferred that the first valve means be an electrically controlled solenoid valve 78. All of the electrically controlled solenoid valves used in the present invention are biased closed when not powered.

The portable refrigerant recovery unit 10 comprises a second valve means in the intermediate conduit 46 between the third and fourth junctions 74, 76 for controlling refrigerant flow between the fourth and third junctions 76, 74. Preferably, the second valve means allows refrigerant to flow from the third junction 74 to the fourth junction 76 and prevents refrigerant from flowing from the fourth junction 76 to the third junction 74. Preferably, the second valve means comprises a check valve 80 to prevent refrigerant from flowing back to the condenser coil 56 and third junction 74.

As shown in FIG. 1, a return conduit 82 extends between the first and third junctions 70, 74. A third valve means is located in the return conduit 82 for controlling flow of refrigerant through the return conduit 82. In the present embodiment, the third valve means comprises an electrically controlled solenoid valve 84.

The unit 10 further includes a by-pass conduit 86 extending between the second and fourth junctions 72, 76. In the preferred embodiment, the by-pass conduit 86 has a length which is less than the length of the intermediate conduit 46 between the second and fourth junctions 72, 74, and, preferably, as short a length as possible, to minimize the amount of refrigerant which remains in the unit 10 after transfer to an external container 110.

A fourth valve means is provided in the by-pass conduit 86 for controlling refrigerant flow through the by-pass conduit 86 between the second and fourth junctions 72, 76. In the present embodiment, the fourth valve means comprises an electrically controlled solenoid valve 88.

The portable refrigerant recovery unit 10 includes level measuring means for determining a level (not shown) of substantially liquid refrigerant in the internal container 38. As presently preferred, the level measuring means is an electro-mechanical flotation device 90 which includes a float (not shown) within the internal container 38. Electro-mechanical flotation devices are well known to those skilled in the art. Accordingly, further description thereof is omitted for purposes of convenience only and is not limiting. One of ordinary skill in the art also understands that the level measuring means may be any automatic means by which the level of substantially liquid refrigerant in the internal container 38 may be determined, such as by use of a photoelectric optical device, for example.

The unit 10 includes control means in communication with the level measuring means for disabling the compressor 14 when the level measuring means determines that the level of substantially liquid refrigerant in the internal container 38 has reached a predetermined level (not shown), such as eighty percent of the volumetric capacity of the internal container 38. In the presently preferred embodiment, the control means is comprised of a switch incorporated in the electro-mechanical flotation device 90. When the electro-mechanical device 90 determines that the level of substantially liquid refrigerant within the internal container 38 has reached the predetermined level, the switch interrupts the power supply to the compressor 14 to thereby disable the same. When the compressor 14 is disabled, refrigerant no longer flows into the internal container 38. The technician will then configure the unit 10 to transfer the refrigerant within the internal container 38 to an external container 110, as described in more detail hereinafter.

Referring now to FIG. 2, the portable refrigerant recovery unit 10 comprises a portable housing 92, wherein the first end 28 of the inlet conduit 26 and the second end 66 of the outlet conduit 62 are externally positioned on the housing 92 and the compressor 14, second end 30 of the inlet conduit 26, internal container 38, intermediate conduit 46, first end 64 of the outlet conduit 62, first, second, third, and fourth junctions 70, 72, 74, 76, first, second, third, and fourth valves 78, 80, 84, 88, return conduit 82, by-pass conduit 86, electromechanical device 90 and control means are internally positioned within the housing 92. Preferably, the portable refrigerant recovery unit 10 is hand carryable. In the presently preferred embodiment, the portable housing 92 includes a handle 94. The portable housing 92 may also include apertures (not shown) for facilitating cooling.

Preferably, the portable housing 92 is constructed of sheet metal folded generally in the form of a parallelepiped and includes a recessed area 96 having control elements thereon for controlling the operation of the portable refrigerant recovery unit 10. The control elements preferably include an on-off power switch 98 for energizing the recovery unit 10, handles 100 and 102 for controlling the flow of refrigerant through the inlet and outlet valves 32, 68, respectively, mode switch 104 for controlling the valves 78, 84, 88, pressure indicators 106, 108 for the pressure gauges 34, 52, the first end 28 of the inlet conduit 26, the second end 66 of the outlet conduit 62, the oil inlet port 22, the oil outlet port 20 and the sight glass 24. The remaining elements of the recovery unit 10 are preferably positioned within the housing 92 to provide the unit 10 with an aesthetically pleasing appearance. The recessed area 96 assists in preventing accidental breakage of the elements mounted thereon, such as when the unit 10 is being transported.

Preferably, the weight of the unit 10 is less than 50 pounds in order to facilitate portability. The basic unit is self-contained and includes a standard electrical plug (not shown) which is placed in electrical communication with a conventional power supply of about 115 V (not shown).

The unit 10 may further comprise an external container 110 (shown in phantom) in fluid communication with the second end 66 of the outlet conduit 62 for receiving refrigerant from the internal container 38. Preferably, the external container 110 is a recovery cylinder. However, the external container 110 may be any type of refrigerant or storage container, as is understood by one of ordinary skill in the art. The external container 110 is generally filled to 80% of capacity by weight for purposes of safety. An automatic or manual weight scale 112 may be used to monitor the weight of the external container 110 to determine when the container 110 has reached 80% capacity. In the alternative, a standard, commercially available float gauge in the external container 110 may be used to monitor the volume of refrigerant within the external container 110. The external container or cylinder 110 is a standard, commercially available cylinder, the particulars of which are within the knowledge of those skilled in the art and, therefore, further description thereof is omitted for purposes of convenience only and is not limiting.

The method for recovering refrigerant from the container 12 and storing the refrigerant within the internal container 38 of a portable refrigerant recovery unit 10 according to the present invention will now be described generally with reference to FIGS. 1 and 2.

To prepare for refrigerant recovery from the container 12, the inlet valve 32 and outlet valve 68 are closed. The first end 28 of the inlet conduit 26 is then connected to the outlet 114 of the container 12, which contains the refrigerant to be removed. The inlet valve 32 is then opened to allow refrigerant to flow into the unit 10. The mode switch 104 is placed in a first position such that upon activating the unit 10, the first valve 78 is opened and the third and fourth valves 84, 88 remain closed. The power switch 98 is then placed in the on position to provide power to actuate the compressor 14 and open the first valve 78.

Vaporized or at least substantially vaporized refrigerant (hereinafter fully vaporized or at least substantially vaporized will be referred to collectively as simply "substantially vaporized") is then removed from the container 12, as best shown in FIG. 1. The substantially vaporized refrigerant is preferably removed from the storage container 12 by creating a relatively lower pressure at the outlet (not shown) of the container 12 to withdraw the substantially vaporized refrigerant from the container 12 into the portable refrigerant recovery unit 10. The lower pressure is created by activating the compressor 14 when the power switch 98 is placed in the on position. However, one skilled in the art would understand that many different means may be used to create a lower pressure at the outlet of the container 12, such as a pump (not shown). Also, one of ordinary skill will appreciate that pressurized refrigerant will first flow from the container 12 and its pressure may have to be controlled with valve regulator 36. The removed, substantially vaporized refrigerant is transferred to the compressor 14 through the inlet conduit 26.

The removed substantially vaporized refrigerant is then compressed by the compressor 14 to form a pressurized vaporized refrigerant. The pressurized refrigerant flows from the outlet 18 of compressor 14 through the first valve 78 and intermediate conduit 46 to the inlet 58 of condenser coil 56 where it is at least substantially condensed to liquid refrigerant. A fan (not shown) blows air over the outer surface of the condenser coil 56 to lower the temperature and condense the refrigerant within the condenser coil 56. Other cooling means for condensing the refrigerant may be used, for example a water-cooled condenser.

The substantially liquid refrigerant is then transferred to the internal container 38 located within the unit 10 to thereby fill the internal container 38. As presently preferred, the substantially liquid refrigerant is transferred to the internal container 38 from the condenser coil 56 through the second valve 8 and the intermediate conduit 46.

Next, the level of the substantially liquid refrigerant within the internal container 38 is determined. In the presently preferred embodiment, the level is determined by use of the electro-mechanical flotation device 90. The electro-mechanical flotation device 90 disables the compressor 14 to automatically cease removal of the substantially vaporized refrigerant from the container 12 when the level of the substantially liquid refrigerant within the internal container 38 exceeds the predetermined level of approximately 80% of the capacity of the internal container 38. That is, the switch within the electro-mechanical flotation device interrupts the power supply to the compressor 14 when the level of substantially liquid refrigerant in the internal container 38 reaches the predetermined level. The power switch 98 is then placed in the off position to close all of the valves 78, 86, 88.

The substantially liquid refrigerant stored within the internal container 38 may be transferred to an external container 110 when a service person or other individual desires to empty the internal container 38. For example, the internal container 38 may be emptied when the internal container is filled to 80% of capacity or at the convenience of the service person.

The method for transferring the refrigerant from the internal container 38 comprises forcing pressurized substantially vaporized refrigerant into the internal container 38 such that the liquid refrigerant therein is expelled from the internal container 38 to the external container 110.

To transfer liquid refrigerant from the internal container 38, the inlet valve 32 is closed. The outlet valve 68 should have previously been closed to retain refrigerant liquid and vapor within the unit. The second end 66 of the outlet conduit 62 is connected to the inlet 116 of the external container 110. The outlet valve 68 is then opened. The mode switch 104 is placed in a second position such that upon activating the unit 10, the third and fourth valves 84, 88 are opened and the first valve 78 remains closed. The power switch is then placed in the on position to provide power to actuate the compressor 14 and open the third and fourth valves 84, 88.

Preferably, this forced transfer is accomplished by configuring the first valve 78 to prevent refrigerant flow therethrough between the second and third junctions 72, 74, the third valve 84 to permit refrigerant flow therethrough and through the return conduit 82, the fourth valve 88 to permit refrigerant flow therethrough and through the by-pass conduit 86, and the outlet valve 68 to permit refrigerant flow therethrough to the external container 110.

The compressor 14 is activated to create a generally lower pressure at the inlet 58 of the condenser coil 56 to remove substantially vaporized refrigerant therefrom. The refrigerant vapor flows through the third valve 84 via the intermediate and return conduits 46, 82 to the compressor inlet 16. The refrigerant is vapor compressed in the compressor 14 and expelled at a higher pressure through the intermediate and by-pass conduits 46, 86 and the fourth valve 88 to the inlet 40 of the internal container 38. The compressed refrigerant vapor fills the internal container 38 to force substantially all of the liquid refrigerant from the internal container 38 throughout the outlet 42, which is preferably located proximate the bottom of the internal container 38, to the external container 110.

The internal container 38 and condenser coil 56 are considered to be substantially empty when the pressure gauge 34 indicates that the pressure within the system is approximately 0 psig. When the condenser is hot from prior use, refrigerant will readily boil off. The unit may be run for another minute or two after the gauge reaches 0 psig to assure that all of the refrigerant has been vaporized from the condenser. By locating valve 78 at junction 72 and check valve 80 at junction 76 and minimizing the length of conduit between compressor outlet 18 and internal container 38 through valve 88, only that conduit, the internal container 38 and the conduit downstream from the internal container outlet 42 will contain any refrigerant and that refrigerant should be substantially if not entirely in vapor form. Thus, the present unit not only provides its own means for draining its internal container 38 but also its own means for substantially purging the entire unit of all refrigerant. This latter feature minimizes the contamination of refrigerants with different refrigerants when different refrigerants are handled sequentially with the unit. Preferably, the unit 10 is considered empty when the pressure gauge 34 indicates that the pressure within the system is approximately 0 psi for at least two minutes.

Alternatively or initially, the refrigerant within the container 12 can be directly transferred to the external container 110 through the internal container 38 as the refrigerant is being withdrawn from the container 12. To accomplish this, the substantially liquid refrigerant being transferred to the internal container 38 is simultaneously transferred to the external container 110 while the level of substantially liquid refrigerant within the internal container 38 is maintained at a predetermined level. To transfer refrigerant from the container 12 to the external container 110 through the internal container 38, the inlet and outlet valves 32, 68 are initially closed. The first end 28 of the inlet conduit 26 is connected to the container outlet 114. The second end of the outlet conduit 62 is connected to the inlet 116 of the external container 110. The inlet and outlet valves 32, 68 are then opened. The mode switch 104 is placed in the second position such that the first valve 78 is opened, the third and fourth valves 84, 88 remain closed, and the compressor 14 is actuated when the power switch 98 is placed in the on position.

When the unit 10 is activated by placing the power switch 98 in the on position, the compressor 14 either receives pressurized vapor from the container 12 or creates a generally subatmospheric lower pressure at the container outlet 114 such that substantially vaporized refrigerant flows through the inlet conduit 26 and inlet valve 32 to the compressor 14. The refrigerant vapor is compressed to a generally higher pressure within the compressor 14 and expelled through the intermediate conduit 46 and first valve 78 to the condenser coil 56. The pressurized refrigerant vapor is condensed to a liquid by being cooled within the condenser coil 56. The liquid refrigerant then drains out of the outlet 60 of the condenser coil 56 and flows through the second valve 80 and intermediate conduit 46 to the internal container 38.

As condensed refrigerant begins to flow into the internal container 38 from the condenser coil 56, the level of liquid refrigerant therein begins to rise. The level of liquid refrigerant continues to rise until it reaches a second predetermined level which is less the predetermined level wherein the electro-mechanical flotation device 90 disables the compressor 14. When the liquid refrigerant within the internal container 38 reaches the second predetermined level, the liquid refrigerant flows from the internal container 38 through the outlet conduit 62 and outlet valve 68 into the external container 110 as additional liquid refrigerant enters the internal container 38 due to gravity and/or pressure That is, the liquid refrigerant within the internal container 38 is maintained at the second predetermined level and excess liquid refrigerant entering the internal container 38 causes overflow to pass into the external container 110. This overflow occurs due to the relative positions of the inlet 40 and the outlet 42 of the internal container 38 and because the outlet valve 68 is open and because the internal container 38 is pressurized by the compressor 14.

This process continues until all the refrigerant within the container 12 has been removed, as indicated by a reading of 0 psi on the pressure gauge 34 for the specified period of time, or until the external container 110 has been filled to a desired level. This desired level may be determined by comparing the filled weight of the external container 110 with a predetermined weight by use of the scale 112. Directly filling the external container 110 has the advantage of allowing the unit 10 to remove more refrigerant from the container 12 than the internal container 38 can temporarily hold. After drainage of the container 12, the unit 10 can be self-purged as previously described for its next use.

It is understood by those skilled in the art that the various components, such as the valves, pressure gauges, sight glasses, filters and the like, are standard off-the-shelf items which are interconnected in a manner which is understood by the ordinarily skilled artisan. For convenience only, further description thereof is not believed to be necessary and, therefore, is not limiting.

From the foregoing description, it can be seen that the present invention comprises a portable refrigerant recovery unit 10 and methods of operating and evacuating the same. While recovering refrigerant from a container 12 to an internal container 38 or external container 110 has been described, the unit 10 is equally capable of supplying refrigerant from a conventional external container 110 to the container 12 by connecting such external container 110 with inlet 114 and such refrigerant container 12 with outlet 116.

While individual conduits with junctions and separate solenoid valves are preferred, one will appreciate that the multiple internal fluid connections could be made in other ways. For example, manifolds can be provided at the inlet and/or outlet of compressor 14, condenser 56 and/or internal container 38 to permit plural simultaneous connections between and among such elements of the unit. While junctions and two-way valves have been described, three-way valves might be substituted for one or more junctions and one or more valves in the lines coupled with said junctions. While coupling the inlet of the compressor with the inlet of the condenser has been described for self-purging, one will appreciate that the connection can be made between the compressor inlet and any part of the isolatable condensing circuit which extends between valves 78 and 80.

The various conduits, valves, junctions and couplings disclosed with respect to the embodiment of FIGS. 1 and 2 collectively constitute three interrelated means for fluid coupling, a first means for selectively fluidly coupling compressor inlet 16 with container 12 or condenser coil 56, a second means for selectively fluid coupling the compressor outlet 18 with the condenser coil inlet 58 or internal container inlet 40 and third means for selectively fluidly coupling the internal container inlet 40 with condenser coil outlet 60. One of ordinary skill will appreciate that the various elements used in the disclosed preferred embodiment and/or the alternate fluid coupling and/or control elements noted above could be combined in various other ways to achieve the same or equally effective fluid couplings about the primary compressor, condenser coil and internal container elements of the unit. The contents of related application Ser. Nos. 07/688,191 and 07/618,193 are incorporated by reference.

It will be appreciated by those skilled in the art that other changes could be made to the embodiment described above without departing from the broad inventive concept thereof. It should be understood, therefore, that this invention is not limited to the particular embodiment disclosed, but it is intended to cover all modifications which are within the spirit and scope of the invention, as defined by the appended claims.

We claim:

1. A method for recovering refrigerant from a container and storing the refrigerant within an internal container of a portable refrigerant recovery unit, comprising the steps of:

removing substantially vaporized refrigerant from the container;

compressing the removed substantially vaporized refrigerant to form a pressurized refrigerant;

condensing the pressurized refrigerant to form a substantially liquid refrigerant;

transferring the substantially liquid refrigerant to an internal container located within the unit to thereby fill the internal container;

determining a level of the substantially liquid refrigerant within the internal container;

automatically ceasing the removal of the substantially vaporized refrigerant from the container when the level of substantially liquid refrigerant within the internal container exceeds a predetermined level;

depressurizing the refrigerant condensing within the unit and outside the internal container to revaporize at least a portion of the condensing refrigerant;

recompressing the revaporized refrigerant; and transferring the recompressed refrigerant to the internal container of the unit to expel the substantially liquid refrigerant from the internal container and the unit.

2. A method according to claim 1, wherein the step of removing the substantially vaporized refrigerant from the container includes creating a relatively lower pressure at the outlet of the container to withdraw the substantially vaporized refrigerant from the container into the unit.

3. A method according to claim 1, wherein the step of automatically ceasing the removal of refrigerant from the container comprises automatically disabling a compressor of the unit which removes the substantially vaporized refrigerant from the container and compresses the same.

4. A method for recovering refrigerant from a container, temporarily storing the refrigerant within an internal container of a portable refrigerant recovery unit, and transferring the refrigerant to an external container, comprising the steps of:

removing substantially vaporized refrigerant from the container;

compressing the removed substantially vaporized refrigerant to form a pressurized refrigerant;

condensing the pressurized refrigerant to form a substantially liquid refrigerant;

transferring the substantially liquid refrigerant to an internal container located within the unit to thereby fill the internal container; and simultaneously transferring the substantially liquid refrigerant from the internal container to the external container while maintaining the substantially liquid refrigerant at a predetermined level within the internal container.

5. A method according to claim 4, wherein the step of removing substantially vaporized refrigerant from the container includes creating a relatively lower pressure at the outlet of the container to withdraw the substantially vaporized refrigerant from the container into the unit.

6. A method according to claim 4, wherein the step of transferring the substantially liquid refrigerant from the internal container to an external container comprises forcing a pressurized substantially vaporized refrigerant into the internal container such that the substantially liquid refrigerant therein is expelled from the internal container to the external container.

7. A method for transferring a substantially liquid refrigerant from an internal container of a portable refrigerant recovery unit to an external container, the unit further including a compressor means and a condenser, the compressor means having an inlet in fluid communication with the condenser and an outlet in fluid communication with the internal container comprising the steps of:

actuating the compressor means to draw substantially vaporized refrigerant from the condenser and to compress the vaporized refrigerant; and displacing the substantially liquid refrigerant from the internal container to the external container with the compressed vaporized refrigerant.

8. A method for recovering refrigerant, temporarily storing the refrigerant within an internal container of a portable refrigerant recovery unit, and transferring the refrigerant to an external container outside the unit, comprising the steps of:

drawing substantially vaporized refrigerant into the unit;

compressing the substantially vaporized refrigerant in the unit to form a pressurized refrigerant;

condensing the pressurized refrigerant in the unit to form a substantially liquid refrigerant;

receiving and holding the substantially liquid refrigerant in the internal container of the unit;

depressurizing the condensing refrigerant within the unit and outside the internal container to revaporize at least a portion of the condensing refrigerant;

recompressing the revaporized refrigerant in the unit; and transferring the recompressed refrigerant to the internal container of the unit and expelling the substantially liquid refrigerant from the internal container to the external container with the recompressed refrigerant.

* * * * *